United States Patent [19]

Jackson

[11] 3,934,500

[45] Jan. 27, 1976

[54] MACHINE FOR PRINTING ON CYLINDRICAL OR FRUSTO-CONICAL CONTAINERS WITH ULTRA-VIOLET-LIGHT-SETTING INK

[75] Inventor: John Maxwell Jackson, Potters Bar, England

[73] Assignee: Chromax Limited, England

[22] Filed: Dec. 13, 1974

[21] Appl. No.: 532,399

[30] Foreign Application Priority Data

Dec. 21, 1973 United Kingdom ..... 59582/73

[52] U.S. Cl. ..... 101/38 A; 34/1

[51] Int. Cl.[2] ..... B41F 7/16

[58] Field of Search ..... 101/38, 39, 40, 416 R; 34/1

[56] References Cited

UNITED STATES PATENTS

| | | | |
|---|---|---|---|
| 879,849 | 2/1908 | Biette | 101/38 A |
| 2,188,912 | 2/1940 | Martina | 101/38 A |
| 2,587,534 | 2/1952 | Schwartz et al. | 101/38 A X |
| 2,676,416 | 4/1954 | Calosi et al. | 34/1 |
| 2,908,218 | 10/1959 | Stephan | 101/38 R |
| 3,008,242 | 11/1961 | Sites et al. | 34/1 |
| 3,385,209 | 5/1968 | Freres | 101/38 R |
| 3,584,389 | 6/1971 | Hilton et al. | 34/1 |
| 3,645,201 | 2/1972 | Jackson | 101/38 A |
| 3,850,096 | 11/1974 | Taniguchi | 101/40 |

*Primary Examiner*—Paul E. Shapiro
*Attorney, Agent, or Firm*—Browdy and Neimark

[57] ABSTRACT

A machine for printing on containers in ultra-violet-light-setting ink has a turret fitted with rotatable mandrels for supporting the containers, the axes of the mandrels being radial relative to the axis of the turret, indexing mechanism for intermittently turning the turret to register each mandrel in succession with printing cylinders spaced around the turret, and gear unit for rotating the mandrels and printing cylinders in synchronism. The turret has a cylindrical rim with flat annular upper and lower surfaces, and each mandrel is mounted in a recess in the rim with the recess opening through the lower surface to permit engagement with the printing cylinders and opening through the periphery of the rim to enable containers to be mounted on the mandrels. Ultra-violet light sources are arranged to direct light into the recesses to set ink printed on containers on the mandrels, and the light sources are provided with shrouds which co-operate with the rim to prevent escape of the ultra violet light except into a recess. The light sources may be fixed in which case the shrouds are spaced close to the surfaces of the rim. Alternatively, the light sources and shrouds may be fixed on the turret. The printing cylinders are twice the diameter of the containers and fitted with a printing plate which extends only half way around the cylinder, the surface of the cylinder being spaced below the lower surface of the turret rim, the printing plate having a thickness such that it extends into the recess during printing, and the indexing mechanism being synchronised with rotation of the cylinders so that the printing plate is on the underside of the cylinder during indexing movements of the turret. The recesses may open through the upper surface of the turret rim and a light source arranged to direct light downwards onto a container while the container is being printed through the opening in the lower surface of the rim, so that the ink on the leading edge of an image printed on the container will be cured before the trailing edge is printed, whereby the trailing edge can overprint the leading edge without risk of smudging the ink.

14 Claims, 13 Drawing Figures

Figure 1:
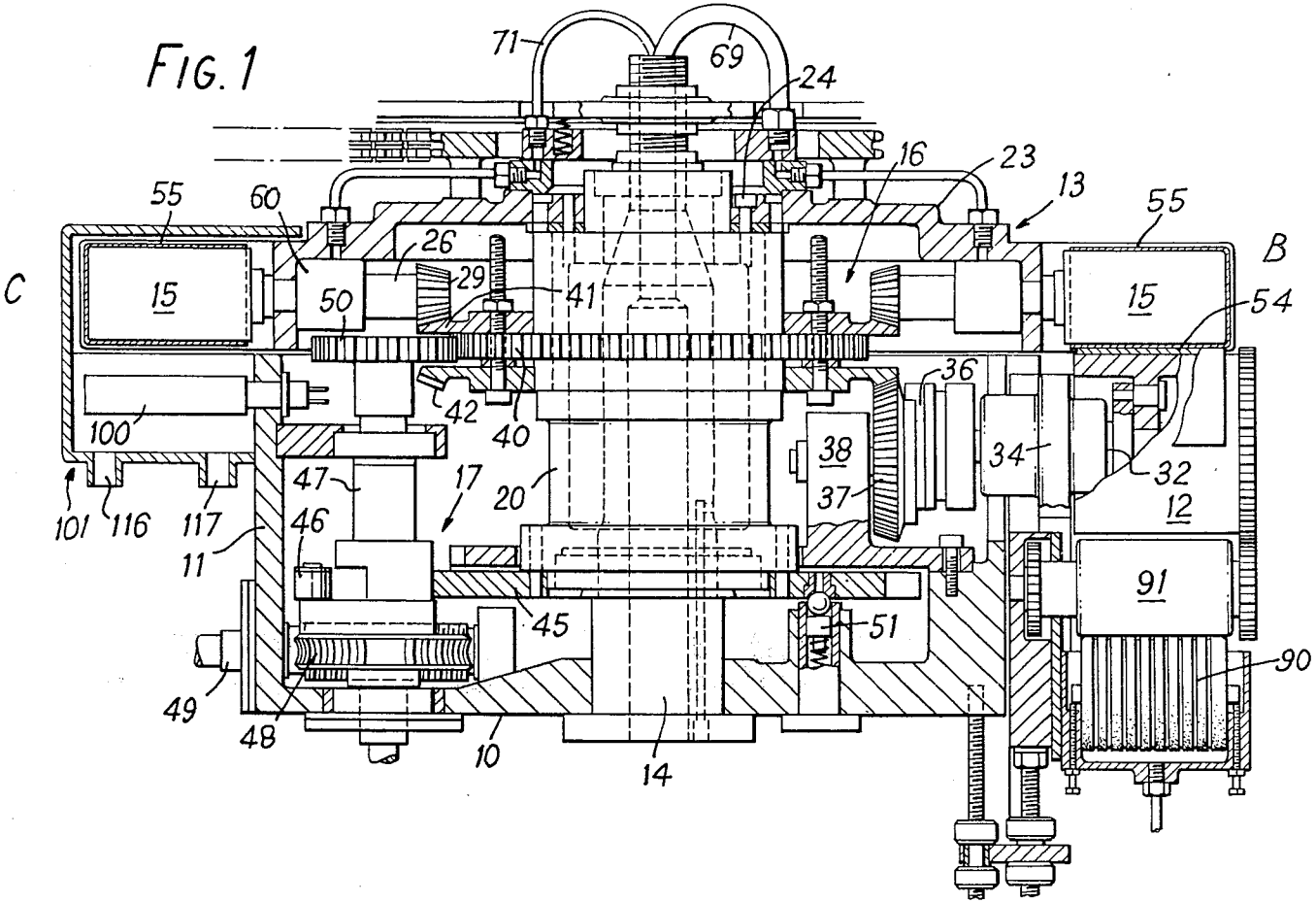

FIG. 2
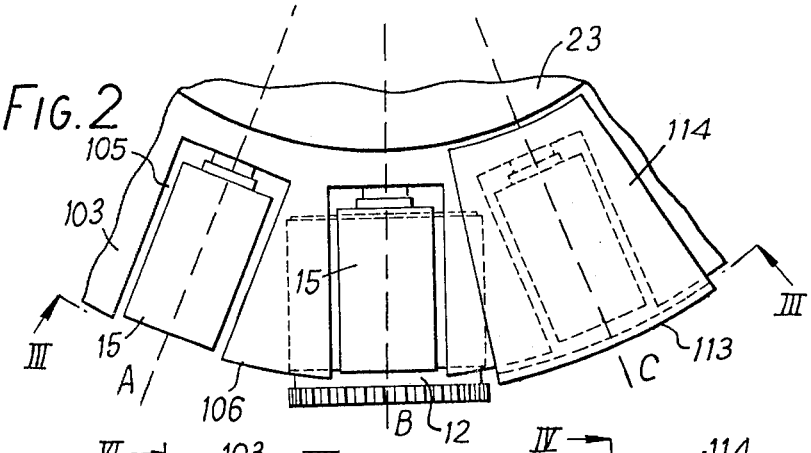
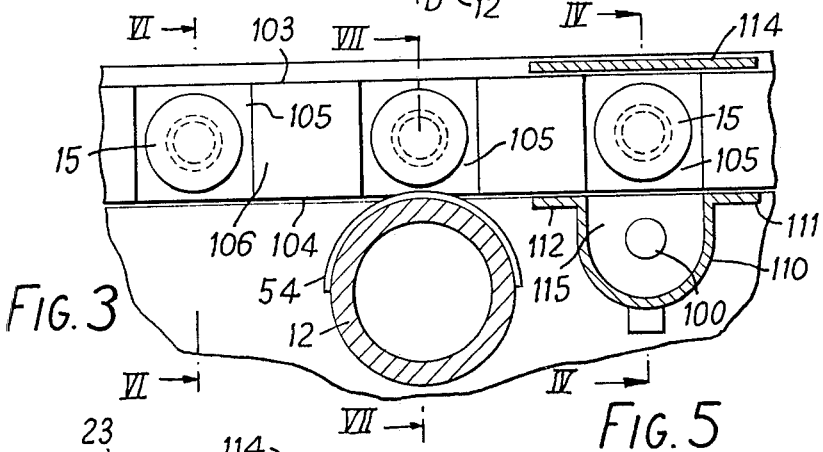
FIG. 3
FIG. 4
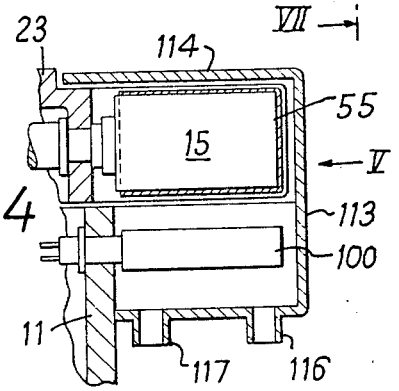
FIG. 5
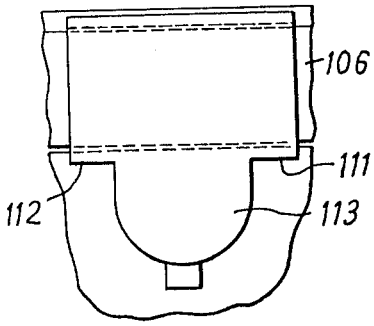
FIG. 6
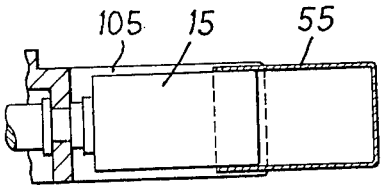
FIG. 7
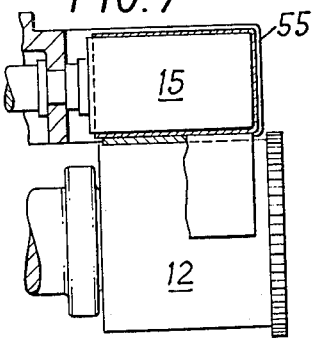

MACHINE FOR PRINTING ON CYLINDRICAL OR FRUSTO-CONICAL CONTAINERS WITH ULTRA-VIOLET-LIGHT-SETTING INK

This invention relates to machines for printing on the surfaces of cylindrical or frusto-conical containers, and is concerned more particularly with multi-cylinder printing machines of the kind described in British Pat. Specification No. 1,316,272 and comprising a frame, a turret rotatably mounted on the frame, the turret having a plurality of rotatable mandrels for supporting cylindrical or frusto-conical containers to be printed, indexing means operable to turn the turret intermittently so as to index each mandrel in succession with printing stations around the turret, a plurality of printing cylinders rotatably mounted one at each of the printing stations, means for applying ink to the printing cylinders, and gear means for rotating the mandrels and printing cylinders in synchronism to ensure registration of the successive images printed by the printing cylinders on containers supported on the mandrels.

The object of the invention is to provide a multi-cylinder printing machine of the above-mentioned kind which is suitable for use with inks which set when subjected to ultra violet light. Such inks have the advantage that they set in a very short time, typically a fifth of a second or less, when subjected to ultra violet light, so that a machine using such inks could be operated at very high speed. Moreover, the ink does not set under normal atmospheric conditions so that there would be no need to wash off the ink from the printing mechanism when the machine was closed down. Hitherto use of such ink has not been possible in multicylinder printing machines of the above-mentioned kind due to the difficulty in preventing escape of the ultra violet light. An operator subjected to such light may suffer skin or eye damage, and any light which fell on part of the printing mechanism would cause premature setting of the ink therein and block the flow of ink to the printing cylinders.

According to the present invention there is provided a multi-cylinder printing machine of the above-mentioned kind and adapted to print in ultra violet light setting inks on containers mounted on the mandrels, wherein each mandrel is mounted in a recess in the turret with at least one side of the mandrel exposed to permit printing engagement between the printing cylinders and a container on the mandrel, and at least one ultra violet light source is arranged to direct light into the recesses to cure ink printed on the containers, the light source being provided with a shroud co-operating with the turret to prevent escape of light except into a recess.

The ultra violet light setting inks may be fluid for use with flexographic or rotagravure printing systems or they may be of the high viscosity type for use with offset letterpress printing systems.

Embodiments of the invention will now be described, by way of example, with reference to the accompanying drawings, in which:

FIG. 1 is a sectional elevational view of a multi-cylinder flexographic printing machine adapted to print on cylindrical containers in ultra violet light setting inks in accordance with the invention, FIG. 2 is a plan view of part of the turret of the machine of FIG. 1, showing mandrels in register with a loading station A, a printing station B, and a drying station C, FIG. 3 is a part-sectional elevation view taken along a curved line III—III in FIG. 2

Figure 8:
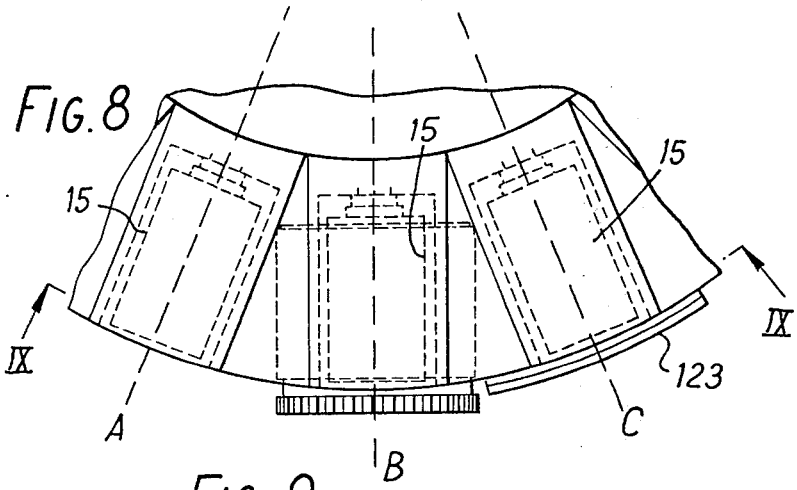
Figure 9:
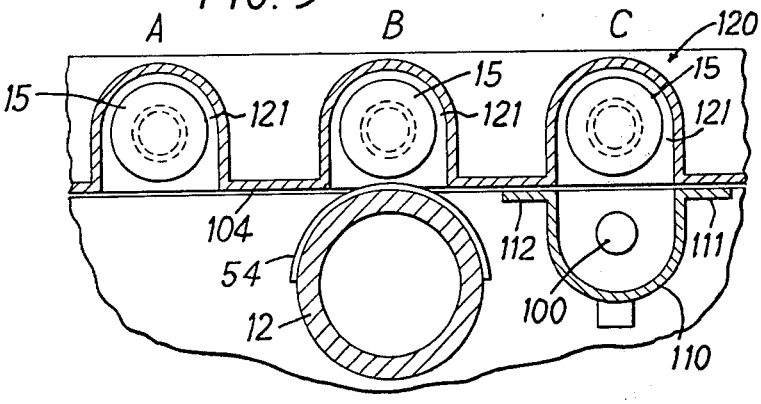
Figure 10:
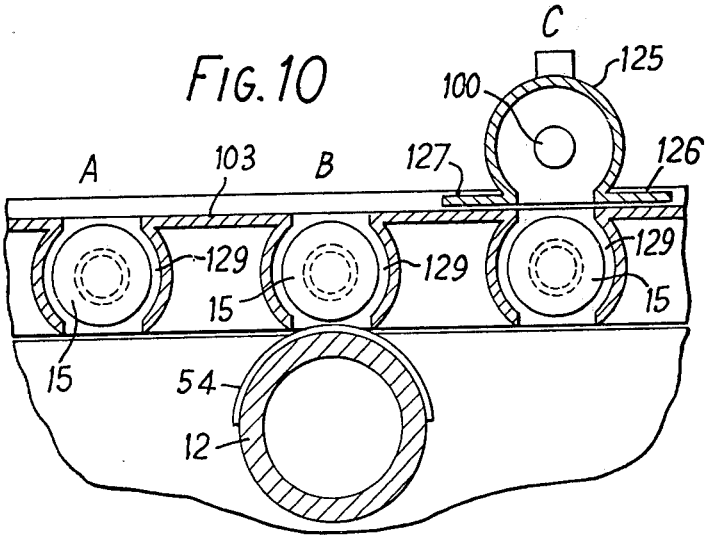
Figure 11:
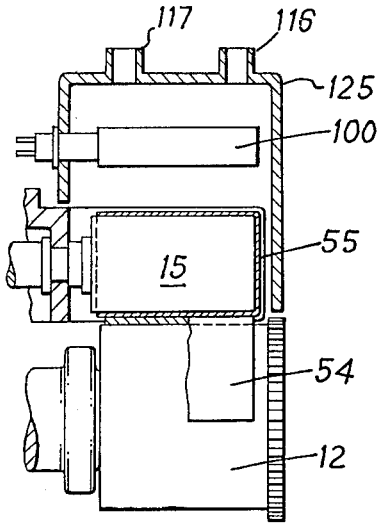
Figure 12:
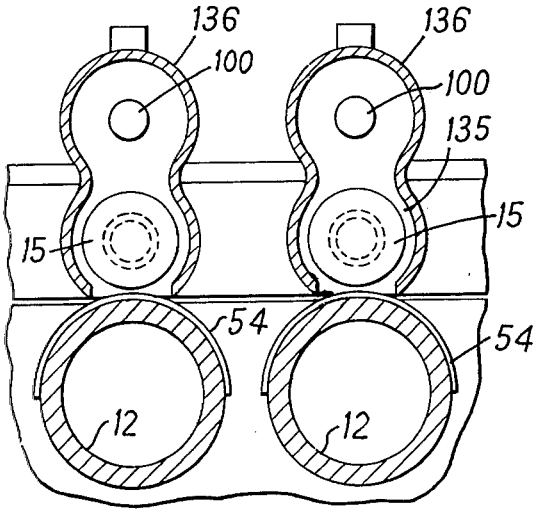
Figure 13:
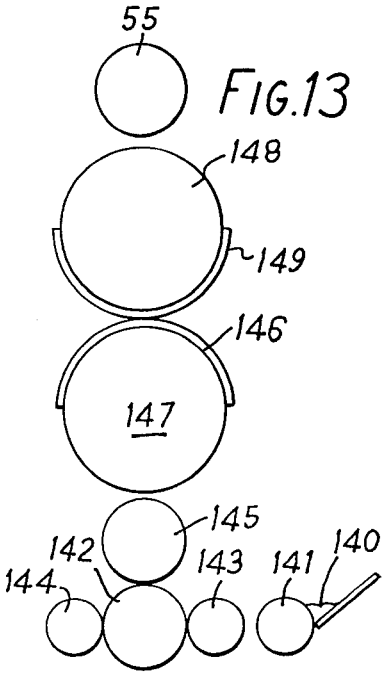

FIG. 4 is a sectional view through the drying station C, taken along the line IV—IV in FIG. 3 and showing a container mounted on the mandrel, FIG. 5 is an end elevation view of the part of the machine at the drying station C, taken in the direction of the arrow V in FIG. 4, FIG. 6 is a sectional view through the loading station A, taken along the line VI—VI in FIG. 3 and showing a container being mounted on the mandrel, FIG. 7 is a sectional view through the printing station B, taken along the line VII—VII in FIG. 3 and showing a container mounted on the mandrel, FIG. 8 is a plan view of part of the turret of a modified construction of the machine of FIG. 1, showing the loading station A, the adjacent printing station B and the adjacent drying station C, FIG. 9 is a part-sectional elevation view taken along the curved line IX—IX in FIG. 8, FIG. 10 is a sectional elevation view, similar to that of FIG. 9, of part of the turret of a further modified construction of the machine of FIG. 1, showing only the parts of the machine at the loading station A, the adjacent printing station B, and the adjacent drying station C, FIG. 11 is a sectional view through a printing station of another modified construction of the machine of FIG. 1 in which drying of the ink is carried out at the printing station, FIG. 12 is a sectional elevation view of part of the turret of yet another modified construction of the machine of FIG. 1 in which drying of the ink is carried out at the printing stations, and FIG. 13 is a diagrammatic view of offset printing mechanism which may replace the flexographic printing mechanism in the machine of FIG. 1.

The multi-cylinder flexographic printing machine shown in FIG. 1 is substantially the same as the printing machine shown and described in British Pat. Specification No. 1,316,272 except that the turret is fitted with cylindrical mandrels and modified to co-operate with mechanism for setting ultra violet light setting inks at the drying stations in accordance with the present invention. A brief description of the construction and operation of the printing machine is given hereinafter to facilitate understanding of the ultra violet light ink setting mechanisms illustrated in the drawings, but the same reference numerals have been used to identify similar parts of the two printing machines and reference may be made to British Pat. Specification No. 1,316,272 for a fuller description of the parts of the machine not connected with the ink setting mechanism.

Referring now to the drawings of the present application, the machine shown in FIG. 1 comprises a base 10 having a peripheral wall 11, several printing cylinders 12 mounted one at each of separate printing stations B spaced apart around the outside of the wall 11, several sources 100 of ultra violet light mounted in separate shrouds 101 at drying stations C spaced around the outside of the wall 11 and associated one with each printing station B, a turret 13 rotatably mounted on a vertical spindle 14 on the base 10, the turret having a plurality of mandrels 15 spaced at equal angular intervals around the periphery of the turret, a master gear unit 16 rotatably mounted on the turret and adapted to rotate the printing cylinders 12 and mandrels 15 in synchronism, and a Geneva indexing mechanism 17 operable to index the turret in one direction of rotation to register each mandrel in turn at a loading station A (FIG. 2), each of the above-mentioned printing stations B and drying stations C, each drying station C following the associated printing station B in the direction of rotation of the turret, and then at an unloading station (not shown). The sectional elevation view in FIG. 1 is taken through a printing station B shown on the right hand side and a drying station C shown on the left hand side, and the plan view in FIG. 2 shows the loading station A, the adjacent printing station B and the associated drying station C.

The turret 13 comprises a sleeve 20 supported in roller bearings (not shown) on the spindle 14, and a top plate 23 secured by bolts 24 on a shoulder on the upper end of the sleeve 20. The top plate 23 has a circular rim formed with flat upper and lower surfaces 103, 104 and rectangular recesses 105 which accommodate the mandrels 15, each recess 105 opening through the upper and lower surfaces 103, 104 and also opening through the outer peripheral wall 106 of the turret. Each of the mandrels 15 is secured on the outer end of a drive shaft 26 rotatably mounted in a bush 60 secured to the top plate 23 of the turret, the axis of the shaft 26 being radial relative to the vertical axis of the spindle 14, and a bevel gear 29 is secured on the inner end of the shaft 26. The bush 60 is formed with passageways adapted to connect ducts in the mandrel either to air extractor means through a pipe 69 or to a source of compressed air through a pipe 71 in order to grip or release respectively a container 55 on the mandrel in a manner not forming part of the present invention.

Each of the printing cylinders 12 is secured on the outer end of a drive shaft 32 rotatably mounted in a bearing housing 34 vertically adjustable in guides on the wall 11 of the base, the axis of the shaft 32 being radial relative to the vertical axis of the spindle 14, and a bevel gear 37 is drivably connected to the shaft 32 by means of a universal joint 36, the gear 37 being supported in a bearing block 38 secured on the base. The universal joint 36 enables the housing 34 which supports the printing cylinder to be lowered to disengage the printing cylinder from a container on the mandrel in a manner not forming part of the present invention.

The master gear unit 16 comprises a main gear 40 rotatably mounted on the sleeve 20 of the turret, and two bevel gears 41, 42 secured to the gear 40 on opposite sides thereof for rotation therewith. The gear 40 meshes with a gear 50 on a vertical shaft 47, the bevel gear 41 meshes with the bevel gears 29 drivably connected to the mandrels 15, and the bevel gear 42 meshes with the bevel gears 37 drivably connected to the printing cylinders 12. The vertical shaft 47 is driven by a worm wheel 48, and a worm 49.

The indexing mechanism 17 comprises a Maltese Cross plate 45 secured to the turret for rotation therewith, and an interlocking driver 46 on the vertical shaft 47, the driver 46 being adapted to engage successive teeth on the plate 45 in successive revolutions of the shaft 47 in the manner known per se and not forming part of the present invention. The indexing mechanism is arranged to turn the turret during part only of each revolution of the shaft 47 to register each mandrel with the next succeeding station. During the remainder of each revolution of the shaft 47, the turret is held stationary by ball detent mechanism 51.

Each printing cylinder 12 is fitted with a flexographic printing plate 54 which extends around only one half of the peripheral surface of the cylinder, the cylinder 12 being of a size such that the radius of the printing plate 54 is twice the radius of the container to be printed, and the ratios of the gears 50, 40, the gears 29, 41 and the gears 37, 42 are selected so that during each revolution of the vertical shaft 47, each mandrel 15 rotates through two revolutions, each cylinder 12 rotates through one revolution in the opposite direction whereby the peripheral speed of the container on the mandrel and the flexographic plate on the cylinder is exactly the same, and during the stationary period of the turret each container on a mandrel in register with a printing station rotates a full revolution along the full length of the flexographic printing plate on the printing cylinder 12. The printing plate 54 on each cylinder is supplied with ultra violet light setting ink by inking mechanism 90, 91.

The ultra violet light source 100 at each drying station C is mounted on the wall 11 as shown in FIG. 4, and the shroud 101 comprises a semi-cylindrical housing 110 secured to the wall 11, the housing 110 having horizontal flanges 111, 112 spaced close to the lower surface 104 of the turret, an arcuate end plate 113 which closed off the outer end of the housing and extends upwards close to the peripheral wall 106 of the turret, and a horizontal plate 114 integral with the end plate 113 and spaced close to the upper surface 103 of the turret. The flanges 111, 112 and plates 113, 114 are of a size such that they overlap a wide margin of the top plate 23 surrounding each recess 105 when the mandrel in the recess is in register with the drying station C, so that the shroud 101 co-operates with the top plate of the turret to form a closed chamber 115 which prevents escape of light from the source 100. The housing 110 is provided with inlet and outlet ports 116, 117 for circulating air therethrough to cool the light source. The internal surfaces of the shroud 101 which face into the chamber 115, when a mandrel is in register with the drying station, are preferably reflective so as to reflect the maximum amount of light onto a container on the mandrel, but the surfaces of the shroud 101 which overlap the top plate 23 of the turret when a mandrel is in register with the drying station are preferably painted black or otherwise made light-absorbing to prevent escape of light therethrough by reflection from these surfaces. For the same reason, the upper and lower surfaces 103, 104 of the turret are preferably painted black and the walls of the recesses 105 made reflective.

In the operation of the machine, the vertical shaft 47 drives both the gear unit 16 and the indexing mechanism 17 so that the mandrels 15 and printing cylinders 12 rotate continuously in synchronism with one another and in synchronism with the intermittent indexing movements of the turret. A container 55 is fitted on each of the mandrels whenever the mandrel comes into register with the loading station A, as shown in FIG. 6. Thereafter the turret is turned by the indexing mechanism to register the container at the printing station B, the printing plate 54 on the cylinder prints an image in ultra violet light setting ink on the container as the cylinder and container rotate during the period of dwell of the container at station B, the turret is turned again to register the container at the drying station C, and the ink on the container is set by the ultra violet light when it is subjected to the light upon rotation of the container during the period of dwell at station C. It will be noted that the container must lie wholly within the recess 105 since otherwise it would strike the shroud 101 upon movement into station C, and the printing cylinder 12 must lie below the lower surface 104 of the turret since otherwise the turret would strike the cylinder during its indexing movements. The printing plate 54 is however made of a thickness such that it will make contact with a container at station B, and the indexing mechanism is arranged so that the movement of the turret takes place during passage of the printing plate 54 below the axis of the cylinder 12. The turret is of course indexed further to register each container with each printing station B and with a drying station C following each printing station B. The provision of a separate drying station C for each printing station B has the advantage that the printed images on a container can be contiguous or overlapped without risk of smudging of the images. If however the images are to be spaced from one another only one drying station C need be provided.

As shown in FIGS. 8 and 9, the turret may have a top plate 120 which is shaped to form radially extending recesses 121 which are open only at the undersides and at the outer ends thereof, the parts of the turret between the recesses having a flat lower surface 104. The mandrels are mounted in the recesses and the shroud for the light source 100 consists only of the semi-cylindrical housing 110 formed with flanges 111, 112 spaced close to the flat lower surface 104 of the turret and an end plate 123 which closes off the outer end of the housing 110 and extends upwards across the open outer end of the recess 121 with only a small gap between the outer rim of the turret and the end plate 123 so as to prevent escape of light.

The light source 100 may be mounted above the turret as shown in FIG. 10, in which case the turret has a flat upper surface 103 and the light source has a shroud consisting of a part-cylindrical housing 125 formed with flat horizontal flanges 126, 127 spaced close to the upper surface 103 of the turret, and an end plate (not shown) which closes off the outer end of the housing 125 and extends downwards across the open outer end of the recess 129 containing the mandrel with only a small gap between the outer rim of the turret and the end plate. The recesses 129 must of course be open at the top to provide access to the ultra violet light, and in addition must be open at the bottom to provide access to the printing cylinder. The walls of each of the recesses 129 are curved and spaced close to the mandrels to prevent escape of light through the bottom opening of the recess, and in addition these walls are light-absorbing to prevent escape of light by reflection through the bottom opening.

FIG. 11 shows a modification of the arrangement of FIG. 10 in which the light source 100 is provided at the printing station B, thereby eliminating the need to provide a separate drying station C for each printing station.

This arrangement has also the advantage that, during printing of an image which extends around the full circumference of a container, the leading edge of the image on the rotating container passes below the light source and is cured, that is set, by the ultra violet light before the trailing edge of the image is printed. There is thus no risk of the printing cylinder smudging the leading edge of the image during printing of the trailing edge, and in fact the printing cylinder can conveniently be arranged so that the trailing edge of the image overprints the leading edge so as to ensure that there is no gap unprinted between the leading and trailing edges of the image.

FIG. 12 shows an arrangement in which the light sources 100 are mounted on the turret, one above each mandrel 15. The mandrels are mounted in recesses 135 in the top plate of the turret, the recesses being open at the top and bottom, and the light sources are provided with part-cylindrical shrouds 136 for directing the light downwards into the recesses. The shrouds 136 can be integral with the top plate of the turret as shown in FIG. 12. The radially inner ends of the recesses 135 and shrouds 136 are closed, and their outer ends are screened by an annular plate (not shown) mounted on the frame of the machine and extending across the ends of the recesses and the shrouds. This annular plate is cut away at the loading and unloading stations to enable the containers to be fitted on and removed from the mandrels and the power supply for each light source is cut off automatically during movement of the light source across the cut away portion of the annular plate. As in the arrangement of FIG. 10, the walls of the recesses 135 must be curved, spaced close to the mandrels and provided with a light-absorbing coating to prevent escape of light through the bottom openings of the recesses. This arrangement also has the advantage of the arrangement of FIG. 11 that the trailing edge of an image can be overprinted on the leading edge.

The flexographic printing unit 90, 91 may be replaced by an offset printing unit as shown diagrammatically in FIG. 13. The offset unit comprises an ink duct 140 one wall of which is formed by the surface of metering roll 141. Ink on the roll 141 is transferred to a transfer roll 142 by a pick-up roll 143 which oscillates between the rolls 141, 142. An idler roll 144 assists in spreading the ink on roll 142 which is then transferred to an inkling roller 145. The ink on roller 145 is transferred to a printing plate 146 mounted on a cylinder 147 which rotates in unison with an offset cylinder 148 carrying an offset printing blanket 149. An ink image on the plate 146 is transferred to the blanket upon rolling of the plate over the blanket, and the image on the blanket is in turn transferred onto a container 55 mounted on a mandrel of the machine, the cylinder 148 corresponding to the cylinder 12 of the machine shown in FIG. 1.

What we claim is:

1. A multi-cylinder printing machine for printing on the surfaces of cylindrical or frusto-coincal containers in ultra-violet-light-setting inks, comprising a frame, a turret rotatably mounted on the frame, the turret having a plurality of rotatable mandrels for the containers to be printed, indexing means operable to turn the turret intermittently so as to index each mandrel in succession with printing stations around the turret, a plurality of printing cylinders rotatably mounted one at each of the printing stations, means for applying the ultra-violet-light-setting inks to the printing cylinders, and gear means for rotating the mandrels and printing cylinders in synchronism to ensure registration of the successive images printed by the printing cylinders on containers supported on the mandrels, wherein each mandrel is mounted in a recess in the turret with at least one side of the mandrel exposed to permit printing engagement between the printing cylinders and a container on the mandrel, and at least one ultra violet light source is arranged to direct light into the recesses to cure ink printed on the containers, the light source being provided with a shroud co-operating with the turret to prevent escape of light except into a recess.

2. A machine as claimed in claim 1, wherein the recesses for the mandrels open through an annular surface on the turret, each mandrel lies wholly within its recess, each printing cylinder is fitted with a printing plate which extends partially around the cylinder, the cylinder being arranged with its peripheral surface spaced from the plane of said annular surface on the turret and the printing plate having a thickness such that it is adapted to extend into each recess to print on a container on the mandrel therein when the mandrel is in register with the printing cylinder, and the rotation of the printing cylinders is synchronised with the indexing movement of the turret so that the printing plate on each cylinder is on the side of the cylinder remote from said annular surface during index movements of the turret.

3. A machine as claimed in claim 1, wherein said light source is fixed relative to said frame, and the recesses for the mandrels open through an annular surface on the turret, the shroud for the light source co-operating with the annular surface to prevent escape of light.

4. A machine as claimed in claim 3, wherein the shroud has surfaces spaced close to and overlapping a wide margin of said annular surface surrounding each recess when the mandrel in the recess is in register with the light source, said overlapping surfaces on the shroud and said annular surface being provided with a light absorbing coating to prevent escape of light by reflection therefrom.

5. A machine as claimed in claim 3, wherein the shroud for the light source comprises a part-cylindrical housing formed with flanges spaced close to said annular surface, the flanges overlapping a wide margin of said annular surface surrounding each recess when the mandrel in the recess is in register with the light source.

6. A machine as claimed in claim 5, wherein the recesses open through a circular peripheral surface of the turret, and the shroud includes a curved end plate which closes off the outer end of said housing and extends with small clearance across the circular peripheral surface to close the open end of a recess in register with the light source.

7. A machine as claimed in claim 3 wherein the turret has a circular rim formed with flat upper and lower surfaces, the recesses for the mandrels are formed in said rim and open through the upper and lower surfaces and through the circular peripheral surface of the turret, and the shroud has plates which overlap wide margins of each of said surfaces surrounding each recess when the mandrel in the recess is in register with the light source.

8. A machine as claimed in claim 7, wherein said upper, lower and peripheral surfaces of the turret are formed with a light absorbing coating and the surfaces of the plates of the shroud facing said surfaces of the turret are also provided with a light absorbing coating to prevent escape of light by reflection therefrom.

9. A machine as claimed in claim 3 wherein the turret has a circular rim formed with annular upper and lower surfaces, the recesses for the mandrels are formed in said rim and open through said upper and lower surfaces and through the circular peripheral surface of the rim, the light source is arranged to direct light into a recess through the opening in one of said annular surfaces, and each printing cylinder is arranged to print on a container through the opening in the other annular surface, the shroud co-operating with said one annular surface and the circular peripheral surface of the turret to prevent escape of light therebetween, and the walls of the recess being spaced close to the mandrel and provided with a light-absorbing coating to prevent escape of light through the opening in said other annular surface.

10. A machine as claimed in claim 9, wherein the light source is arranged to direct ultra violet light into a recess when the mandrel therein is in register with a printing cylinder whereby, during the printing of an image which extends around the full circumference of a container on the mandrel, the leading edge is set by the light prior to the trailing edge of the image being printed.

11. A machine as claimed in claim 9, and including a plurality of light sources associated one with each of the printing cylinders, wherein the printing cylinders are mounted below the lower surface of the rim of the turret and the light sources are mounted above the upper surface of the rim and each arranged to direct light into the recess of a mandrel in register with the associated printing cylinder.

12. A machine as claimed in claim 1 and including a plurality of light sources associated one with each of the printing cylinders, each light source being mounted on the frame of the machine and provided with a separate shroud co-operating with the turret to prevent escape of light.

13. A machine as claimed in claim 1 and including a plurality of light sources mounted on the turret and adapted to direct light into each of said recesses for the mandrels, the recesses opening through a surface of the turret remote from the light sources to expose the mandrels for printing engagement between the printing cylinders and containers on the mandrels, and the walls of the recess being spaced close to the mandrel and provided with a light-absorbing coating to prevent escape of light through the openings.

14. A machine as claimed in claim 1, wherein the means for applying ink to the cylinders comprises an ink duct one wall of which is formed by the surface of a metering roll, a transfer roll spaced from the metering roll, a pick up roll spaced between the metering and transfer rolls, means for reciprocating the pick-up roll to bring it alternately into rolling contact with the metering roll and the transfer roll, and idler roll in rolling contact with the transfer roll, an inking roller in rolling contact with the transfer roll, a cylinder having a printing plate thereon adapted to make rolling contact with the inking roller upon rotation of the cylinder, an offset cylinder having an offset printing blanket adapted to make rolling contact with the printing plate, and means for rotating said cylinders in unison and rotating the metering roll, the printing blanket being adapted to print on to a container mounted on a mandrel an image transferred to the blanket from the printing plate.

* * * * *